United States Patent [19]

Grisham et al.

[11] Patent Number: 4,850,144

[45] Date of Patent: Jul. 25, 1989

[54] DOOR EXTENSION APPARATUS

[76] Inventors: Fred A. Grisham, 4130 Bartlett Country Rd., Bartlett, Tenn. 38134; C. Lynwood Grisham, 9016 Anderton Springs Dr., Memphis, Tenn. 38133

[21] Appl. No.: 302,370

[22] Filed: Jan. 27, 1989

[51] Int. Cl.[4] ..... E06B 7/16; E06B 3/00

[52] U.S. Cl. ..... 49/482; 49/484; 49/488; 49/489; 49/501

[58] Field of Search ..... 49/482, 484, 501, 488, 49/489, 493; 52/821, 813

[56] References Cited

U.S. PATENT DOCUMENTS

| | | | |
|---|---|---|---|
| 377,838 | 2/1888 | Pratt . | |
| 1,973,210 | 9/1934 | Hufnail et al. . | |
| 2,024,192 | 12/1935 | Verhagen . | |
| 3,374,580 | 3/1968 | Ruff | 49/482 |
| 3,380,194 | 4/1968 | Biro . | |
| 3,413,762 | 12/1968 | Baude . | |
| 3,871,133 | 3/1975 | Ellingson, Jr. | 49/488 X |
| 4,255,902 | 3/1981 | Ruff | 49/488 |
| 4,712,331 | 12/1987 | Fujiwara . | |

FOREIGN PATENT DOCUMENTS

| | | | |
|---|---|---|---|
| 1497616 | 10/1967 | France | 49/501 |
| 1316453 | 5/1973 | United Kingdom | 49/501 |

*Primary Examiner*—Philip C. Kannan

*Attorney, Agent, or Firm*—Walker & McKenzie

[57] ABSTRACT

A door extension apparatus for use with a door having a bottom edge and having grooves in the bottom edge for normally receiving weather strips. The apparatus includes a first extension member for being secured to the grooves in the bottom edge of the door, the first extension member having a bottom edge, the bottom edge of the first extension member having grooves therein; and a second extension member for being secured to the grooves in the bottom edge of the first extension member.

5 Claims, 1 Drawing Sheet

FIG. 1
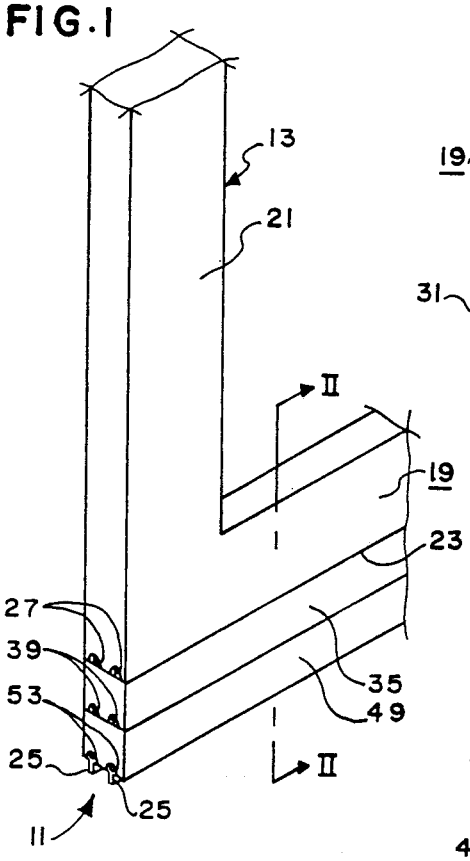
FIG. 2
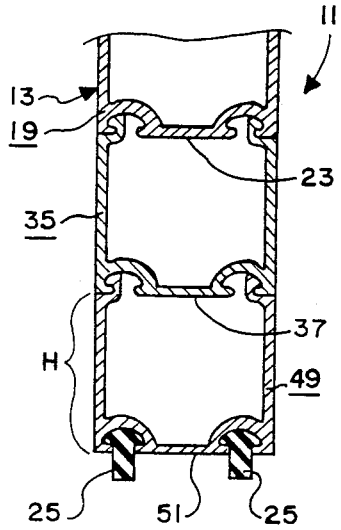
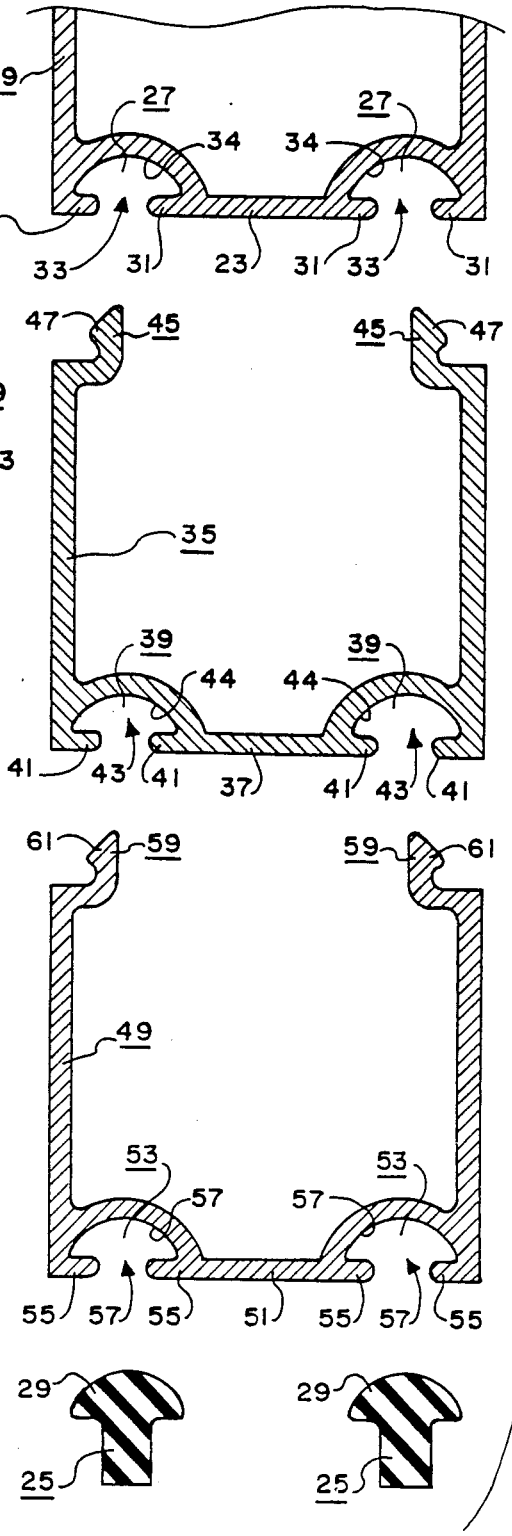
FIG. 3

DOOR EXTENSION APPARATUS

BACKGROUND OF THE INVENTION

1. Field of the Invention

The present invention relates, in general, to means for adjusting the height of a door.

2. Information Disclosure Statement

A preliminary patentability search conducted in class 49, subclasses 482, 488, 489, and 501 disclosed the following patents which may be relevant to the present invention: Pratt, U.S. Pat. No. 377,838; Hufnail et al, U.S. Pat. No. 1,973,210; Verhagen, U.S. Pat. No. 2,024,192; Biro, U.S. Pat. No. 3,380,194; Baude, U.S. Pat. No. 3,413,762; and Fujiwara, U.S. Pat. No. 4,712,331. Pratt discloses a door having a horizontal recess in its lower edge and vertical grooves in its side edges, plates fitted in the vertical grooves, each plate having a longitudinal slot with beveled edges, and a roller journaled in and between the lower ends of the plates and rotating in the recess. Hufnall et al discloses an automatic compensating device including a sealing member movable mounted to the edge of a door or the like and a spring or the like for urging the sealing member outward from the door or the like for sealing an opening around the door or the like. Verhagen discloses a metallic window sash consisting of a bottom rail composed of two extruded aluminum sections and a rubber sealing strip held to the bottom of the bottom rail. Biro discloses a telescopic expander mounted to an edge of a door or the like to provide a good seal therefore; longitudinal grooves are provided on the edge of the expander for receiving and gripping an elastomer weather strip. Baude discloses a door edge adjustment device including an adjustment channel slidably fitted within a recess in the edge of the door, compression springs for urging the adjustment channel outward, and adjustment screws for holding the adjustment channel to the door. Fujiwara discloses a door having an air shielding member having a deformable portion attached to a side edge thereof.

None of the above patents disclose or suggest the present invention. Thus, for example, none of the above patents disclose or suggest a door extension apparatus including a first extension member for being secured to the grooves in the bottom edge of a door, the first extension member having a bottom edge, the bottom edge of the first extension member having grooves therein; and a second extension member for being secured to the grooves in the bottom edge of the first extension member.

SUMMARY OF THE INVENTION

The present invention is directed toward providing an improved space compensation means for sealing openings between the bottom edge of a door and a threshold. The concept of the present invention is to provide a door extension apparatus including a first extension member for being snapped into grooves in the bottom edge of a door and having grooves in its bottom edge, and a second extension member for being snapped into the grooves in the bottom edge of the first extension member, etc.

A door extension apparatus of the present invention includes a first extension member for being secured to grooves in the bottom edge of a door, the first extension member having a bottom edge, the bottom edge of the first extension member having grooves therein; and a second extension member for being secured to the grooves in the bottom edge of the first extension member.

BRIEF DESCRIPTION OF THE DRAWINGS

FIG. 1 is a perspective view of a portion of the door extension apparatus shown attached to a portion of a door.

FIG. 2 is an enlarged sectional view as taken on line II—II of FIG. 1.

FIG. 3 is an enlarged exploded view of FIG. 2.

DESCRIPTION OF THE PREFERRED EMBODIMENT

The door extension apparatus 11 of the present invention is for use with a door 13 and is designed to be attached to a horizontal edge of the door 13 to extend or increase the effective height of the door 13 in order to compensate for variations in the height of the door 13 or the door opening or doorframe (not shown) within which the door 13 is to be mounted. More specifically, the door extension apparatus 11 insures that the top and bottom edges of the door 13 make proper contact with the sill or threshold of the door opening or doorframe.

The door 13 may be a typical metal security door including a horizontal top rail (not shown), a horizontal bottom rail 19, a vertical first side rail 21, and a vertical second side rail (not shown) welded or otherwise securely joined to one another to form a rigid rectangular unit or the like as will now be apparent to those skilled in the art. An intermediate horizontal rail, ornamental structure, glass panels, locking hardware and the like (not shown) are typically included in the door 13 as will now be apparent to those skilled in the art.

The bottom rail 19 has a bottom edge 23 for being positioned directly above the sill or threshold of the door opening or doorframe when the door 13 is closed as will now be apparent to those skilled in the art. The door 13 includes one or more weather strips 25 for normally being attached to the bottom edge 23 of the bottom rail 19 to provide a weather-tight seal between the bottom edge 23 and the sill or threshold of the door opening or doorframe when the door 13 is closed. The bottom edge 23 of the bottom rail 19 of the door 13 has one or more grooves 27 therein for normally receiving the head 29 of the weather strips 25 to secure the weather strips 25 to the door 13 in a manner as will now be apparent to those skilled in the art. Preferably, the bottom edge 23 of the bottom rail 19 has a pair of parallel grooves 27 therein for allowing a pair of weather strips 25 to be secured thereto as will now be apparent to those skilled in the art. Each weather strip 25 preferably has an enlarged mushroom-shaped head portion 29 and each of the grooves 27 preferably has a pair of shoulders 31 extending toward one another to form a narrow neck 33 and an enlarged mushroom-shaped head portion 34 (see, in general, FIG. 3) for normally receiving the enlarged head portion 29 of a weather strip 27.

The door extension apparatus 11 includes a first extension member 35 for being secured to the bottom edge 23 of the bottom rail 19 of the door 13. The first extension member 35 has a bottom edge 37 that is preferably identical to the bottom edge 23 of the bottom rail 19. Thus, the bottom edge 37 of the first extension member 35 preferably has a pair of parallel grooves 39 therein for allowing a pair of weather strips 25 to be secured thereto as will now be apparent to those skilled in the art. Each of the grooves 39 preferably has a pair of shoulders 41 extending toward one another to form a narrow neck 43 and an enlarged mushroom-shaped head portion 44 (see, in general, FIG. 3).

The first extension member 35 preferably includes a pair of projection means 45 for extending into the grooves 27 in the bottom edge 23 of the bottom rail 19 of the door 13 to secure the first extension member 35 to the door 13. Each projection means 45 preferably has an enlarged head portion 47 for fitting over a shoulder 31 of one of the grooves 27 in the bottom edge 23 of the bottom rail 19 of the door 13. The projection means 45 may be snapped into the grooves 27 or slid thereinto as will now be apparent to those skilled in the art to fixedly secure the first extension member 35 to the bottom edge 23 of the bottom rail 19 of the door 13 as will now be apparent to those skilled in the art.

The door extension apparatus 11 includes a second extension member 49 for being secured to the bottom edge 37 of the first extension member 35. The second extension member 49 has a bottom edge 51 that is preferably identical to the bottom edge 23 of the bottom rail 19 and the bottom edge 37 of the first extension member 35. Thus, the bottom edge 51 of the second extension member 49 preferably has a pair of parallel grooves 53 therein for allowing a pair of weather strips 25 to be secured thereto as will now be apparent to those skilled in the art. Each of the grooves 53 preferably has a pair of shoulders 55 extending toward one another to form a narrow neck 57 and an enlarged mushroom-shaped head portion 58 (see, in general, FIG. 3).

The second extension member 49 preferably includes a pair of projecting means 59 for extending into the grooves 39 in the bottom edge 37 of the first extension member 35 to secure the second extension member 49 to the first extension member 35. Each projection means 59 preferably has an enlarged head portion 61 for fitting over a shoulder 41 of one of the grooves 39 in the bottom edge 37 of the first extension member 35. The projection means 59 may be snapped into the grooves 39 or slid thereinto as will now be apparent to those skilled in the art to fixedly secure the second extension member 49 to the bottom edge 37 of the first extension member 35 as will now be apparent to those skilled in the art.

The door extension apparatus 11 may include additional extension members with bottom edges and projection means identical to the first and second extension members 35, 49 to allow the effective height of the door 13 to be additionally increased. Further, it should be noted that the height of the extension members determined by the distance between the bottom edge and projection means of each extension member and as represented by the bracket H in FIG. 2 may vary to allow fairly precise adjustment of the effective height of the door 13 as will now be apparent to those skilled in the art. Thus, extension members may be provided with a height H of, for example, ½ inch, 1 inch, etc., as will now be apparent to those skilled in the art.

The extension members 35, 49 may be manufactured in various manners and out of various materials as will now be apparent to those skilled in the art. For example, the extension members 35, 49 may be extruded out of aluminum or the like.

The operation and use of the apparatus 11 is quite simple. When mounting the door 13 to a door opening, the door 13 and door opening are accurately measured. If the gap between the door 13 and the sill or threshold of the door opening is too great to be taken up by the weather strips 25 alone, then the extension member 35 is slid into or snapped onto the grooves 27 in the bottom edge 23 of the bottom rail 19 of the door 13 as will now be apparent to those skilled in the art. Additional extension members may then be slid into or snapped onto the grooves 39 in the bottom edge 37 of the extension member 35.

Although the present invention has been described and illustrated with respect to a preferred embodiment and a preferred use therefor, it is not to be so limited since modifications and changes can be made therein which are within the full intended scope of the invention.

I claim:

1. A door extension apparatus for use with a door having a bottom edge and having one or more grooves in said bottom edge for receiving one or more weather strips; said apparatus comprising:

(a) a first extension member for being snapped into said grooves in said bottom edge of said door, said first extension member having a bottom edge, said bottom edge of said first extension member having grooves therein; and (b) a second extension member for being snapped into said grooves in said bottom edge of said first extension member.

2. A door extension apparatus for use with a door having a bottom edge, said bottom edge of said door having a first groove therein extending across said door for receiving a first weather strip and having a second groove therein extending across said door for receiving a second weather strip; said apparatus comprising:

(a) a first extension member for being snapped into said grooves in said bottom edge of said door, said first extension member having a bottom edge and a top edge, said top edge of said first extension member having a first projection means for being snapped into said first groove in said bottom edge of said door and having a second projection means for being snapped into said second groove in said bottom edge of said door, said bottom edge of said first extension member having a first groove therein extending across said first extension member for receiving a first weather strip and having a second groove therein extending across said first extension member for receiving a second weather strip; and (b) a second extension member for being snapped into said grooves in said bottom edge of said first extension member, said second extension member having a bottom edge and a top edge, said top edge of said second extension member having a first projection means for being snapped into said first groove in said bottom edge of said first extension member and having a second projection means for being snapped into said second groove in said bottom edge of said first extension member.

3. The door extension apparatus of claim 2 in which said bottom edge of said second extension member has a first groove therein extending across said second extension member for receiving a first weather strip and having a second groove therein extending across said second extension member for receiving a second weather strip.

4. The door extension apparatus of claim 3 in which each of said grooves has a shoulder and in which each of said projection means has a head portion for snapping over said shoulder of one of said grooves.

5. A door extension apparatus for use with a door having a bottom edge, said bottom edge of said door having a first groove therein extending across said door for receiving a first weather strip and having a second groove therein extending across said door for receiving a second weather strip; said door extension apparatus comprising a plurality of extension members for being stacked one on top of the other and attached to said bottom edge of said door to extend the length of said door, each of said extension members having a bottom edge and a top edge, said bottom edge of each of said extension member having a first groove therein for receiving a first weather strip and having a second groove therein for receiving a second weather strip, said top edge of each of said extension members having a first projection means for being snapped into said first groove in said bottom edge of said door or said bottom edge of one of said extension members and having a second projection means for being snapped into said second groove in said bottom edge of said door or said bottom edge of one of said extension member, each of said grooves having a shoulder and each of said projection means having a head portion for snapping over said shoulder of one of said grooves.

* * * * *